US012588775B2

(12) United States Patent
Zhang et al.

(10) Patent No.: US 12,588,775 B2
(45) Date of Patent: Mar. 31, 2026

(54) LYING NECK PILLOW THAT IS EASY TO ADJUST AND USE

(71) Applicant: Guangzhou New Design Biotechnology Co. Ltd., Guangzhou (CN)

(72) Inventors: Shaowei Zhang, Guangzhou (CN); Silei Zou, Guangzhou (CN)

(73) Assignee: Guangzhou New Design Biotechnology Co. Ltd., Guangzhou (CN)

( * ) Notice: Subject to any disclaimer, the term of this patent is extended or adjusted under 35 U.S.C. 154(b) by 63 days.

(21) Appl. No.: 18/676,798

(22) Filed: May 29, 2024

(65) Prior Publication Data

US 2025/0325124 A1 Oct. 23, 2025

(30) Foreign Application Priority Data

Apr. 18, 2024 (CN) ..... 202410465087.3

(51) Int. Cl.
*A47G 9/10* (2006.01)

(52) U.S. Cl.
CPC ..... *A47G 9/1081* (2013.01); *A47G 9/1009* (2013.01)

(58) Field of Classification Search
CPC ..... A47G 9/10; A47G 9/1081; A61H 1/0296
See application file for complete search history.

(56) References Cited

U.S. PATENT DOCUMENTS

| | | | | |
|---|---|---|---|---|
| 6,823,546 | B1 * | 11/2004 | Hsu | A61H 7/001 5/639 |
| D972,148 | S * | 12/2022 | Peng | D24/183 |
| 2016/0278553 | A1 * | 9/2016 | Biebl | A47G 9/1081 |
| 2024/0197553 | A1 * | 6/2024 | Chen | A61H 23/0263 |

FOREIGN PATENT DOCUMENTS

| | | | | |
|---|---|---|---|---|
| CN | 215075666 | U * | 12/2021 | |
| CN | 215686432 | U * | 2/2022 | |
| CN | 219166798 | U * | 6/2023 | |
| CN | 219166803 | U * | 6/2023 | |
| DE | 202021001064 | U1 * | 4/2021 | A61H 39/04 |
| JP | 3230799 | U * | 2/2021 | A61F 5/042 |
| KR | 20230172801 | A * | 12/2023 | A47G 9/1081 |
| KR | 20230173356 | A * | 12/2023 | A47G 9/1081 |
| WO | 2013078864 | A1 | 6/2013 | |

* cited by examiner

*Primary Examiner* — Eric J Kurilla
(74) *Attorney, Agent, or Firm* — Westbridge IP LLC

(57) ABSTRACT

A lying neck pillow that is easy to adjust and use includes a neck pillow body and an adjusting piece. The neck pillow body includes a base and a curved supporting portion for supporting neck, a bottom end of the curved supporting portion is connected to the base, and an adjusting space is arranged between the curved supporting portion and the base for elastic deformation of the curved supporting portion. The adjusting piece is detachably installed in the adjusting space, and a soft and hard force and/or support curvature of the curved supporting portion are adjusted by adjusting a support position of the adjusting piece. By changing the support position of the adjusting piece, the soft and hard strength and/or support curvature of the curved supporting portion can be adjusted, thereby improving the comfort of use.

8 Claims, 6 Drawing Sheets

LYING NECK PILLOW THAT IS EASY TO ADJUST AND USE

CROSS-REFERENCE TO RELATED APPLICATIONS

This application claims priority to Chinese Patent Application No. 202410465087.3, filed on Apr. 18, 2024, the content of which is incorporated herein by reference in its entirety.

TECHNICAL FIELD

The present disclosure herein relates to the field of neck pillow technology, particularly to a lying neck pillow that is easy to adjust and use thereof.

BACKGROUND

Lying neck pillow is a pillow body used to support the neck and restore the normal physiological curvature of the cervical spine when lying flat. At present, the lying neck pillow is fixed and cannot be adjusted according to the personalized needs of different users, such as the soft and hard strength and curvature of the support, resulting in poor comfort during use. Therefore, there is an urgent need to improve the existing lying neck pillow.

SUMMARY

In view of the above, the present disclosure provides a lying neck pillow that is easy to adjust and use, in order to adjust the soft and hard strength and curvature of the support, thereby improving the comfort of use.

The technical solution adopted in the present disclosure is as follows.

The present disclosure provides a lying neck pillow that is easy to adjust and use, comprising a neck pillow body and an adjusting piece.

The neck pillow body comprises a base and a curved supporting portion for supporting neck, a bottom end of the curved supporting portion is connected to the base, and an adjusting space is arranged between the curved supporting portion and the base for elastic deformation of the curved supporting portion.

The adjusting piece is detachably installed in the adjusting space, and a soft and hard force and/or support curvature of the curved supporting portion are adjusted by adjusting a support position or strength of the adjusting piece.

Furthermore, the adjusting piece adopts an adjusting ring, the adjusting ring is made of elastic material and has different wall thicknesses, the wall thickness is a thickness between an inner ring and an outer ring, and different support forces are achieved through different wall thicknesses.

Furthermore, a clamping groove is formed on an upper surface of the base and a lower surface of the curved supporting portion, and the adjusting ring is inserted into the clamping groove.

Furthermore, an outer surface of the adjusting ring has an anti-slip stripe.

Furthermore, an outer ring of the adjusting ring is a circular, an inner ring is a rounded square, and the inner ring of the adjusting ring comprises a soft transverse beam and a hard side beam, the soft transverse beam has a certain degree of curvature, forming a top and bottom arc segment of the inner ring, providing support elasticity, and the hard side beam is a straight strip segment, forming two sides of straight strip segments of the inner ring, to provide support strength for the adjusting ring.

Furthermore, the regulating ring is integrally formed using silicone gel.

Furthermore, an upper surface of the curved supporting portion is a saddle surface that conforms to normal physiological curvature of human neck.

Furthermore, it further comprises a cold compressing pad laid on the upper surface of the curved supporting portion.

Furthermore, the cold compressing pad comprises a cushion base and a plurality of cushion blocks protruding from the cushion base, and a breathable mesh groove is formed between a plurality of cushion blocks.

Furthermore, a positioning groove is formed on the upper surface of the curved supporting portion that is suitable for the shape and size of the cold compressing pad, and the cold compressing pad is embedded in the positioning groove.

Furthermore, the cushion blocks adopt a transparent hollow resin shell, the cushion block is filled with a freezing liquid, and the freezing liquid is a colored liquid, the plurality of cushion blocks are capable of choosing the colored liquid of different colors.

The beneficial effects of the present disclosure are as follows.

Compared to the prior art, the present disclosure provides a neck pillow that is easy to adjust and use, the neck pillow body is matched with the adjusting piece, the base of the neck pillow body is matched with the curved supporting portion, the adjusting piece is placed in the adjusting space to support the curved supporting portion, and by changing the support position of the adjusting piece, the soft and hard strength and/or support curvature of the curved supporting portion can be adjusted, thereby improving the comfort of use.

BRIEF DESCRIPTION OF THE DRAWINGS

The accompanying drawings are intended to provide a further understanding of the present disclosure and form a part of the specification, they are used together with the specific embodiments below to explain the present disclosure, but should not constitute a limitation on the present disclosure. In the accompanying drawings.

DETAILED DESCRIPTION OF THE EMBODIMENTS

Figure 1:
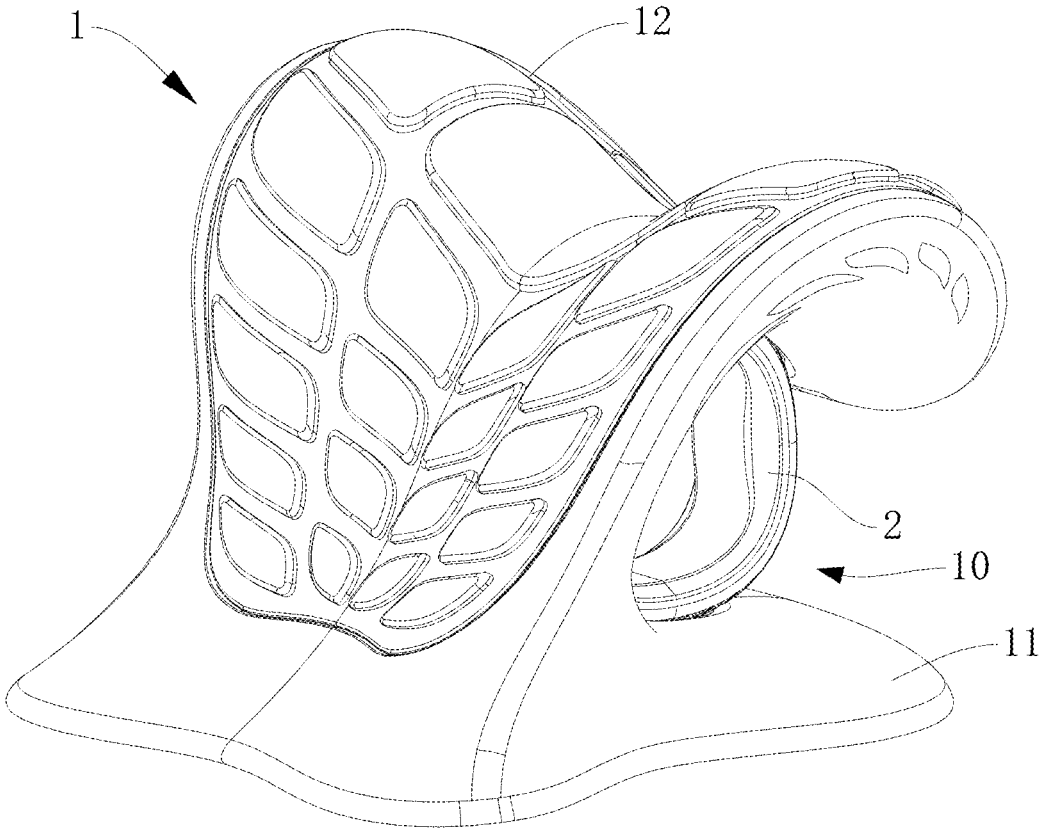
FIG. 1 shows a first view stereogram of a lying neck pillow that is easy to adjust and use in the present disclosure.
Figure 2:
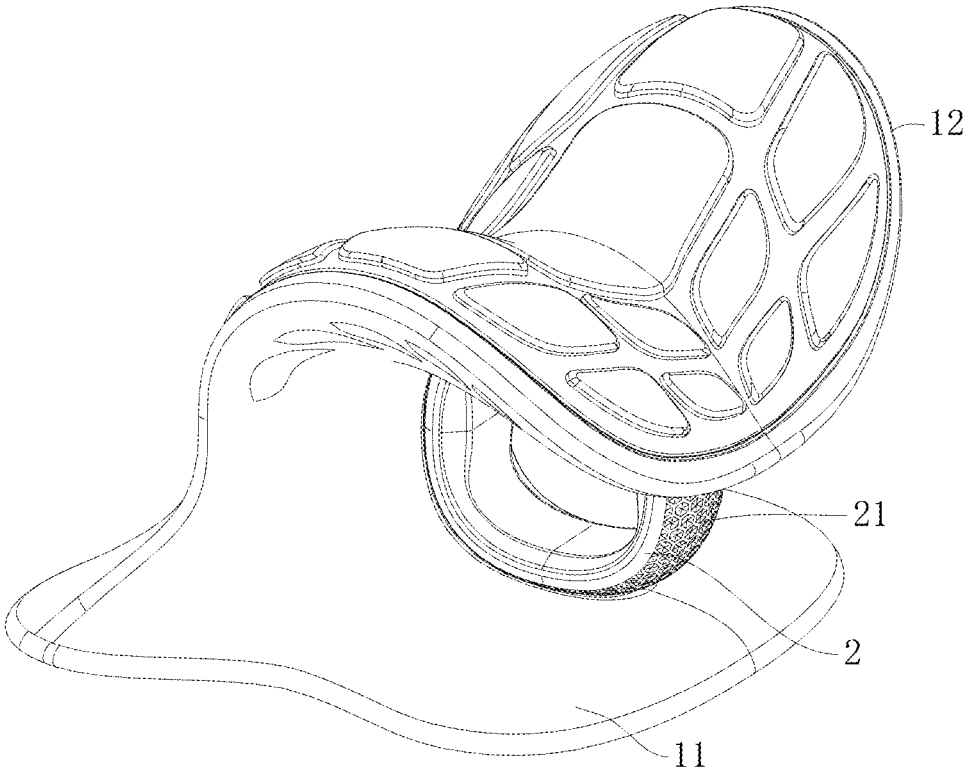
FIG. 2 shows a second view stereogram of a lying neck pillow that is easy to adjust and use in the present disclosure.

The following provides a detailed explanation of the specific embodiment of the present disclosure in conjunction with the accompanying drawings. It should be understood that the specific embodiments described here are only intended to illustrate and explain the present disclosure, and are not intended to limit the present disclosure.

As shown in FIGS. 1 to 5, the present disclosure provides a lying neck pillow that is easy to adjust and use, comprising a neck pillow body 1 and an adjusting piece 2, wherein the neck pillow body 1 comprises a base 11 and a curved supporting portion 12 for supporting neck, a bottom end of the curved supporting portion 12 is connected to the base 11, and an adjusting space 10 is arranged between the curved supporting portion 12 and the base 11 for elastic deformation of the curved supporting portion 12. The adjusting piece 2 is detachably installed in the adjusting space 10, and a soft and hard force and/or support curvature of the curved supporting portion 12 are adjusted by adjusting a support position or strength of the adjusting piece 2.

The present disclosure provides a neck pillow that is easy to adjust and use, the neck pillow body 1 is matched with the adjusting piece 2, the base of the neck pillow body 1 is matched with the curved supporting portion 12, the adjusting piece 2 is placed in the adjusting space 10 to support the curved supporting portion 12, and by changing the support position of the adjusting piece 2, the soft and hard strength and/or support curvature of the curved supporting portion 12 can be adjusted, thereby improving the comfort of use. The adjusting piece 2 can use a hard support element or a soft support element.

In this embodiment, the adjusting piece 2 adopts an adjusting ring, the adjusting ring is made of elastic material, preferably silicone material, the adjusting ring has different wall thickness, the wall thickness is a thickness between an inner ring and an outer ring, and different support forces are achieved through different wall thicknesses. In this way, by rotating the adjusting ring, the wall thickness of the support position can be changed, making adjustment convenient. Preferably, a connected clamping groove 13 is formed on an upper surface of the base 11 and a lower surface of the curved supporting portion 12, and the adjusting ring is inserted into the clamping groove 13, which facilitates stable support.

In order to further improve the stability of the adjusting ring support, an outer surface of the adjusting ring has an anti-slip stripe 21 to prevent the adjusting ring from sliding out of clamping groove 13. Optionally, an outer ring of the adjusting ring is a circular, and an inner ring is a rounded square. In this way, the structure is simple and the manufacturing is simple.

Figure 3:
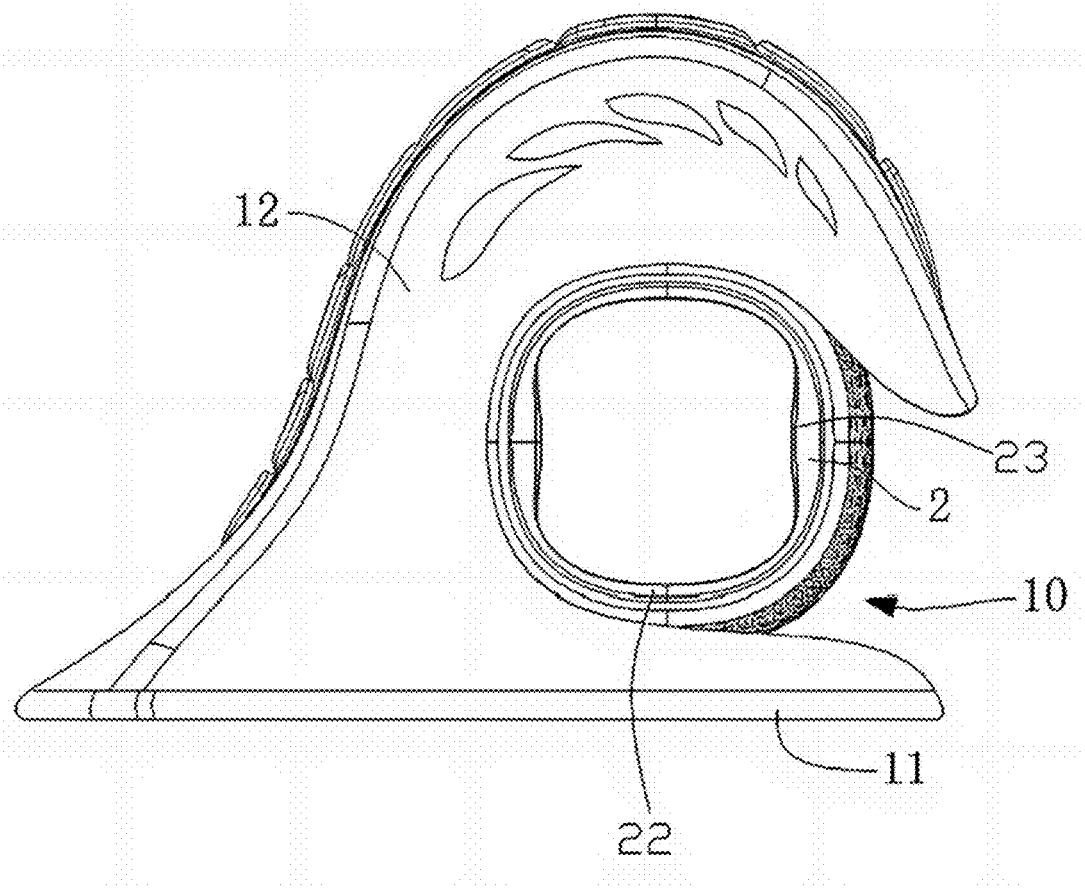
FIG. 3 shows a side view of a lying neck pillow that is easy to adjust and use in the present disclosure.
Figure 4:
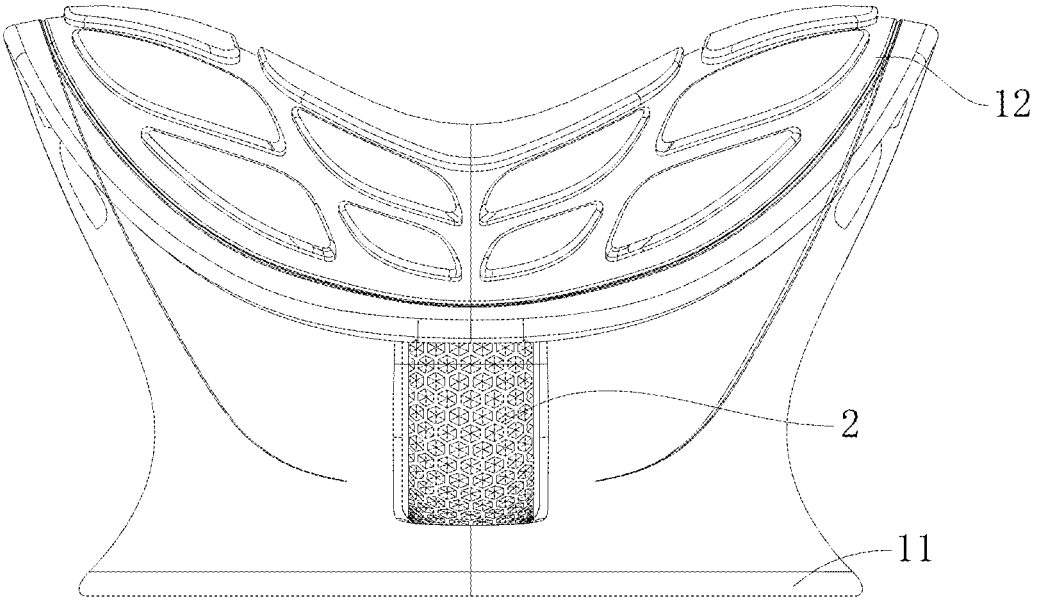
FIG. 4 shows a front view of a lying neck pillow that is easy to adjust and use in the present disclosure.

Furthermore, the entire ring body of the adjusting ring or the inner ring of the adjusting ring can adopt a circular structure consisting of top and bottom arc segments and straight strip segments on both sides, as shown in FIG. 3, the inner ring of the adjusting ring comprises a soft transverse beam 22 and a hard side beam 23, the soft transverse beam 22 has a certain degree of curvature and is located on the top and bottom sides of the adjusting ring, forming a top and bottom arc segment of the inner ring, which are used to connect the bottom surface of the curved supporting portion 12 and the top surface of the base 11, providing support elasticity, the hard side beam 23 is a straight strip segment located on both sides of the adjusting ring, forming the two sides of the straight segment of the inner ring, to provide support strength for the adjusting ring.

It can be understood that in other embodiments, the adjustable member 2 can further adopt a telescopic adjustable support member.

An upper surface of the curved supporting portion 12 is a saddle surface that conforms to normal physiological curvature of human neck, which facilitates the restoration of normal physiological curvature of the cervical spine. The left and right sides of the curved supporting portion 12 are designed with a swan neck biomimetic shape, resembling the swan symbolizing the swan neck, and the shape is beautiful and creates a perfect physiological curve of the cervical spine. Furthermore, the downward extension curvature of the end of the curved supporting portion 12 matches the outer surface of the adjusting ring, and can strengthen the prevention of the adjusting ring from easily sliding out of the adjusting space 10.

Figure 5:
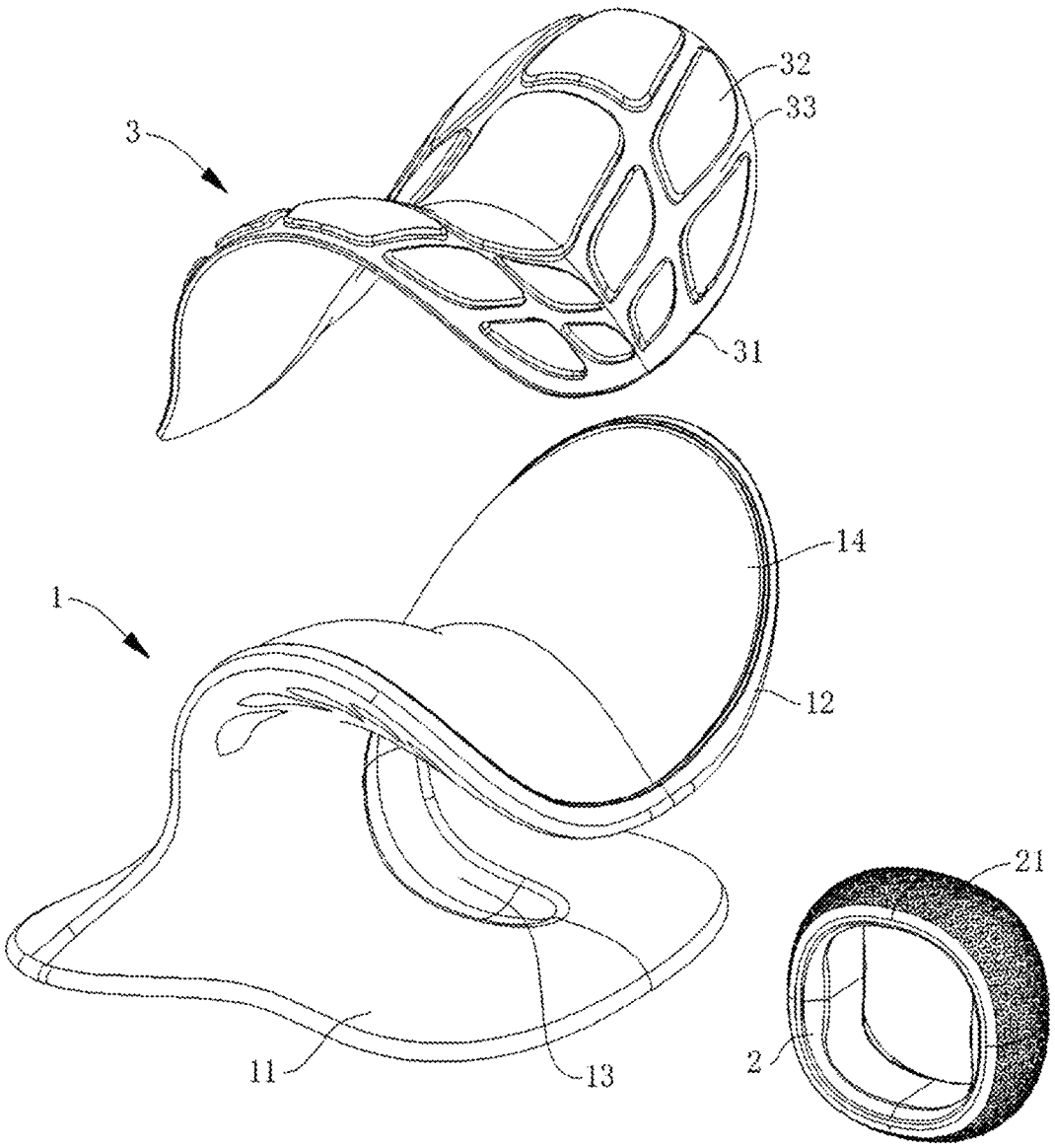
FIG. 5 shows an exploded view of a lying neck pillow that is easy to adjust and use in the present disclosure.

As shown in FIG. 5, the present disclosure provides a lying neck pillow that is easy to adjust and use, it further comprises a cold compressing pad 3 laid on the upper surface of the curved supporting portion 12 to achieve the cold compress function. In order to improve the breathability of the cold compressing pad 3, the cold compressing pad 3 comprises a cushion base 31 and a plurality of cushion blocks 32 protruding from the cushion base 31, and a breathable mesh groove 33 is formed between a plurality of cushion blocks 32. The external air can flow to the neck fitting position through the breathable mesh groove 33, thereby improving the comfort of use.

The cushion block 32 can adopt a transparent hollow drum structure, which can be made of resin and filled with freezing liquid, and the freezing liquid is optionally use a liquid of different colors. A plurality of cushion blocks 32 can be integrated with the cushion base 31. When cooling with freezing liquid, the cold compressing pad 3 can be placed as a whole in the refrigerator or in a frozen environment for cooling, and then laid as a whole on the curved supporting portion 12, and the freezing liquid inside the cushion base 32 can maintain a longer freezing time.

Furthermore, the surface of the cushion block 32 can also form different protrusions or grooves, increasing the comfort of supporting the neck.

Furthermore, the cushion block 32 may not adopt a hollow bulge structure, which is convex on the cushion base 31, and can be integrated with the cushion base 31 in a soft and heat absorbing cushion shape made of gel, which is laid on the upper surface of the curved supporting portion 12.

In order to facilitate precise placement of the cold compressing pad 3 and prevent it from sliding during use, a positioning groove 14 is formed on the upper surface of the curved supporting portion 12 that is suitable for the shape and size of the cold compressing pad 3, and the cold compressing pad 3 is embedded in the positioning groove 14.

In order to improve aesthetics and match the bionic shape of the swan neck, the cushion block 32 is designed in a feather shape.

The neck pillow body 1 can be integrally formed with polyurethane or EVA, which has resilience, high tensile strength, high toughness, antibacterial, non-toxic, odorless, and pollution-free properties.

Figure 6:
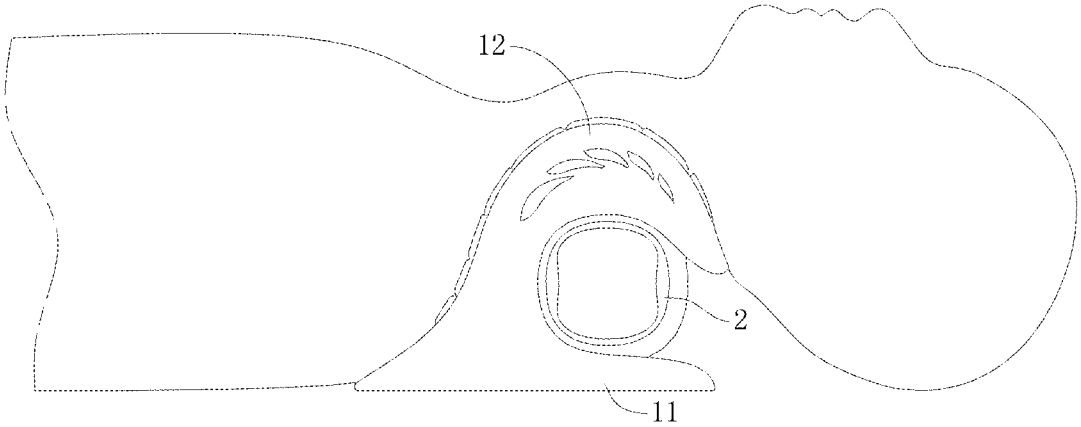
FIG. 6 shows a reference diagram of the usage status of a lying neck pillow that is easy to adjust and use in the present disclosure.

As shown in FIG. 6, when in use, the lying neck pillow is placed on the bed, and the adjusting piece 2 is placed in the adjusting space 10, and the user lies on the bed and the neck is supported on the curved supporting portion 12. If the soft and hard force or support curvature of the curved supporting portion 12 is not suitable, it can be adjusted to the appropriate state by changing the support position of the adjusting piece 2. This structure is simple, easy to adjust, suitable for different users, and can improve the comfort of use.

It can be understood that the adjusting piece 2 can be matched with the clamping groove 13 on the upper surface of the base 11 and a lower surface of the curved supporting portion 12 using a sliding rail groove structure, and the adjusting piece 2 can slide to any position for fixation.

As long as it does not violate the ideas created in the present disclosure, any combination of different embodiments of the present disclosure shall be deemed as the content disclosed in the present disclosure; within the scope of the technical concept of the present disclosure, any combination of multiple simple variations and different embodiments of the technical solution that do not violate the ideas created in the present disclosure shall be within the scope of protection of the present disclosure.

What is claimed is:

1. A lying neck pillow that is easy to adjust and use, comprising:

a neck pillow body, wherein the neck pillow body comprises a base and a curved supporting portion for supporting a user's neck, a bottom end of the curved supporting portion is connected to the base, and an adjusting space is arranged between the curved supporting portion and the base for elastic deformation of the curved supporting portion; and an adjusting piece, wherein the adjusting piece is detachably installed in the adjusting space, and a support force and/or support curvature of the curved supporting portion are adjusted by adjusting a support position or strength of the adjusting piece, wherein the adjusting piece is an adjusting ring, the adjusting ring is made of elastic material and has different wall thicknesses, the wall thickness is a thickness between an inner ring and an outer ring, and different support forces are achieved through different wall thicknesses;

wherein an outer ring of the adjusting ring is circular, an inner ring is a rounded square, and the inner ring of the adjusting ring comprises a soft transverse beam and a hard side beam, the soft transverse beam has a certain degree of curvature, forming a top and bottom arc segment of the inner ring, providing support elasticity, and the hard side beam is a straight strip segment, forming two sides of straight strip segments of the inner ring, to provide support strength for the adjusting ring.

2. The lying neck pillow that is easy to adjust and use according to claim 1, wherein a clamping groove is formed on an upper surface of the base and a lower surface of the curved supporting portion, and the adjusting ring is inserted into the clamping groove.

3. The lying neck pillow that is easy to adjust and use according to claim 1, wherein an outer surface of the adjusting ring has an anti-slip stripe.

4. The lying neck pillow that is easy to adjust and use according to claim 1, wherein an upper surface of the curved supporting portion is a saddle surface that conforms to normal physiological curvature of a human's neck.

5. The lying neck pillow that is easy to adjust and use according to claim 1, further comprising a cold compressing pad laid on the upper surface of the curved supporting portion.

6. The lying neck pillow that is easy to adjust and use according to claim 5, wherein the cold compressing pad comprises a cushion base and a plurality of cushion blocks protruding from the cushion base, and a breathable mesh groove is formed between the plurality of cushion blocks.

7. The lying neck pillow that is easy to adjust and use according to claim 6, wherein the cushion blocks are a transparent hollow resin shell, the cushion block is filled with a freezing liquid, and the freezing liquid is a colored liquid, wherein a user can select different colors of the liquid inside the plurality of cushion blocks.

8. The lying neck pillow that is easy to adjust and use according to claim 5, wherein a positioning groove is formed on the upper surface of the curved supporting portion that is suitable for the shape and size of the cold compressing pad, and the cold compressing pad is embedded in the positioning groove.

* * * * *